United States Patent [19]

Shaw

[11] 4,059,090

[45] Nov. 22, 1977

[54] FIREPLACE HEATING UNIT

[75] Inventor: William Stuart Shaw, Prince George, Canada

[73] Assignee: Humboldt Holdings, Inc., Georgetown, British W. Indies

[21] Appl. No.: 602,226

[22] Filed: Aug. 6, 1975

[30] Foreign Application Priority Data

June 10, 1975 Canada ..... 226443

[51] Int. Cl.[2] ..... F24B 7/04

[52] U.S. Cl. ..... 126/121

[58] Field of Search ..... 126/121, 200; 237/51

[56] References Cited

U.S. PATENT DOCUMENTS

| | | | |
|---|---|---|---|
| 737,382 | 8/1903 | Frederick | 126/121 |
| 1,697,635 | 1/1929 | Cornelius | 126/121 |
| 2,048,675 | 7/1936 | Baruch et al. | 126/140 |
| 2,110,060 | 3/1938 | Cage | 126/121 |
| 2,527,930 | 10/1950 | Howrey | 126/121 |
| 2,642,859 | 6/1953 | Brown | 126/121 |
| 3,762,391 | 10/1973 | Andrews | 126/121 |

*Primary Examiner*—John J. Camby
*Assistant Examiner*—Larry I. Schwartz
*Attorney, Agent, or Firm*—LeBlanc & Shur

[57] ABSTRACT

A fireplace heating unit is disclosed which will efficiently heat the interior of a structure. The unit includes a firebox surrounded by a housing. The housing is vented to the outside at the rear thereof and to the interior of the structure at the front thereof, over the firebox. Exterior air is drawn into the housing through the rear vent and circulated around the firebox and through conduits extending through the chimney flue whereby it is quickly heated. The heated air is then exhausted into the room through the front vent. A portion of the front of the housing may mount a movable glass door having a controlled air inlet therein to control combustion of fuel in the firebox. The door also provides access to the firebox and may be opened to permit use of the firebox as a conventional fireplace, if desired. In one embodiment a zero clearance unit is provided, having a novel bypass to divert at least a portion of the flow of heated air from the interior of the housing into the flue. In another embodiment, a free standing unit is provided which uses a novel baffle means within the housing whereby exterior air may be drawn into the housing and circulated without a fan means. Both housing embodiments may have double, spaced upstanding walls to insulate the unit.

13 Claims, 6 Drawing Figures

FIREPLACE HEATING UNIT

This invention relates to means for efficiently using the heat generated by the combustion of wood, coal, or the like in a fireplace to heat the interior of the structure. In particular, this invention relates to a semi-portable unit with the outward appearance of a conventional home fireplace, when installed. However, the device of this invention also takes in outside air, heats the air, and then directs it into the interior of the surrounding structure to establish convection currents of heated air within the structure.

The common domestic open fireplace heats a room primarily with radiant energy from the fire. Convection currents, much more efficient means for heating, are not established within a room by a conventional fireplace. Therefore, only the area immediately in front of the fireplace is warmed to any degree, by a fire, and the heat capacity of the fuel consumed is largely wasted in the hot combustion gases which are vented to the atmosphere through the chimney flue.

An open fireplace is a very inefficient heating means, not only because the heat capacity of the fuel is largely wasted. In addition, a common open fireplace may draw warm air from within the house into the open flue with the combustion gases which are exhausted through the chimney. This outward flow of warm air depressurizes the interior of the house, drawing in cold outside air through available cracks and openings, for example around doors and windows.

The common fireplace structure then may cause substantial heat loss from within the house, particularly as the fire dies out. If the flue damper is closed this loss will obviously be eliminated. However, in a conventional open fireplace the damper is not closed until the fire is completely out. Therefore the damper normally remains open overnight with a resulting heat loss inside the structure as the fire burns out.

There have been many attempts in the past to design fireplace units that will function as efficient room or space heaters or to provide prefabricated units useful to so adapt an existing fireplace. Certain of the latter devices, however, require extensive reconstruction of an existing fireplace itself in order to incorporate the duct work and heating chambers required. Many other devices were complicated in design and therefore expensive, and still others incorporate very poor heat exchange designs which ineffectively use only a portion of the walls of the firebox to heat air which is subsequently directed into the room. Finally, prior devices make no provision for moderating or controlling the flow of heated air admitted into the room. A simple on-off control is typically the only type of control used in prior devices.

For example, many prior devices use a fan to force a flow of air around the firebox whereby it is heated, and then through a vent into the room. When the room becomes too warm, the fan must be shut off and the vent closed. When the room cools the fan is turned on and the vent opened again, but no means are provided for regulating a flow of air into the room to provide even heating.

It has been discovered, however, that a highly efficient fireplace unit can be constructed, which can be rapidly and inexpensively installed, and which will furnish a controlled flow of warm fresh air to heat a room. The unit of this invention utilizes a firebox with the usual front opening therein. The opening provides access to the interior thereof to supply fuel to the fire, and to observe the fire. The upper portion of the firebox comprises a hood which vents into the flue so that combustion gases exit the unit through the flue in the normal manner. The firebox and hood are surrounded by a housing.

The device of this invention maximizes heat exchange between the combustion gases and the air to be heated in the following manner: Outside air is drawn into the housing, and initially preheated by upward circulation around the firebox from the bottom to a small collection chamber behind the hood. The preheated air is then heated further as it passes through conduits extending through the hood so that the air to be heated is placed in intimate contact with conduit walls heated by the upwardly flowing combustion gases. The heated air then passes through the conduits into a second collection chamber and is vented to the interior of the room or structure to be heated. Outside, fresh air is then rapidly and efficiently heated as it flows across the rising combustion gases from the fire.

In one preferred embodiment of this invention the second or front collection chamber is also vented upwardly into a third collection chamber which is in communication with the flue through a novel bonnet structure connecting the flue and the hood over the firebox. The vent between the second and third chambers is controlled at the vent from the second chamber into the room to be heated. Therefore, the vent into the third chamber provides a by-pass for the flow of heated air normally exiting the second chamber into the room, or at least a portion thereof. The by-pass vent then diverts all, or a portion of, the flow of heated air into the third collection chamber, the bonnet, and finally the flue, as desired. Of course, the by-pass vent may also be closed to divert none of the heated air into the flue.

Although the bonnet permits a flow of air from the third chamber into the flue, the bonnet restricts the flow of gases from the flue into the third chamber. The bonnet ports are covered by upwardly directed louvers so that combustion gases will pass upwardly through the bonnet, and will not back up into the third chamber, and ultimately into the room to be heated.

The heating unit of this embodiment can be installed within a structure, against any wall without providing a clearance therebetween. In the alternative this embodiment may be installed outside of the structure opening thereinto. The firebox opening may be surrounded with a brick facade to simulate a conventional fireplace. A glass door is provided, which normally obstructs the firebox opening. The door, however, may be opened so that the unit will function as a conventional fireplace, if desired.

In another embodiment of this invention, a free standing unit is provided which may also be mounted within a room, quickly and relatively inexpensively. This unit, however, will require its own base and separate foundation as in the case of a conventional fireplace. This embodiment includes a firebox surrounded by a housing. The housing is provided with a rear collection chamber vented to the outside through a port disposed above and behind the firebox. The rear chamber contains a downwardly extending baffle spaced between the firebox and rear wall of the housing. Exterior air is drawn into the chamber and circulates downwardly around the baffle and upwardly along the walls of the firebox. A hood is provided above the firebox which supports an upper extension. The upper extension extends into the flue so that the interior of the hood is in communication with the flue therethrough. Conduits are mounted in the upper extension of the hood so that the preheated air from the rear chamber will pass through the conduits in intimate contact with the upwardly rising combustion gases into a front or second chamber which is vented into the room to be heated.

Because of the unique baffle arrangement in the rear chamber a blow-back of preheated air from the chamber through the vent to the exterior is prevented and therefore a fan means is not necessary for efficient operation.

Both embodiments of this invention may be constructed so that the walls of the housing are double spaced thicknesses for insulating purposes, and both may be constructed with the movable glass door for visual access to the firebox. The glass door also has a controlled vent therein so that when the door is closed air from the room is admitted at a controlled rate for even burning. When it is desired to extinguish the fire then the vent need only be closed, and the door will prevent the flow of room air into the firebox and up the flue.

Accordingly, it is an object of this invention to provide an efficient and safe fireplace heating means for establishing convection currents of heated, fresh air within a room.

It is another object to provide a heating device which may be utilized either as a conventional open fireplace, or as a device having the appearance of a conventional fireplace but providing heat by efficient use of the heat capacity available through controlled combustion of wood, coal, and the like within the fireplace.

It is another object of this invention to provide a semi-portable heating unit which may be rapidly installed within a structure for heating outside air by circulating said air through a stream of hot combustion gases and subsequently directing said air into a room.

It is still another object of this invention to provide a fireplace heating unit which efficiently utilizes the heat generated by combustion of fuel in a firebox by circulating outside air around the firebox, and through conduits extending through the flue containing a stream of hot combustion gases to heat the outside air, and subsequently directing said heated outside air into the room.

It is yet another object of the present invention to provide a fireplace heating unit adapted to direct a flow of unheated air around a firebox through conduits extending through the stream of hot combustion gases exiting the firebox and subsequently directing at least a portion of said heated air into the structure to be heated while directing the remaining flow through a bonnet into the flue.

It is still another object of this invention to provide a free standing unit for efficiently utilizing the heat capacity of wood combusted therein, which unit circulates unheated air from the outside around a depending baffle and along the sides of a firebox, and subsequently through conduits extending transverse to a stream of hot combustion gases from the firebox, and into a room whereby a stream of heated air will warm the room by establishing convection currents therein.

These and other objects will become readily apparent with reference to the drawings and following description wherein.

Figure 2:
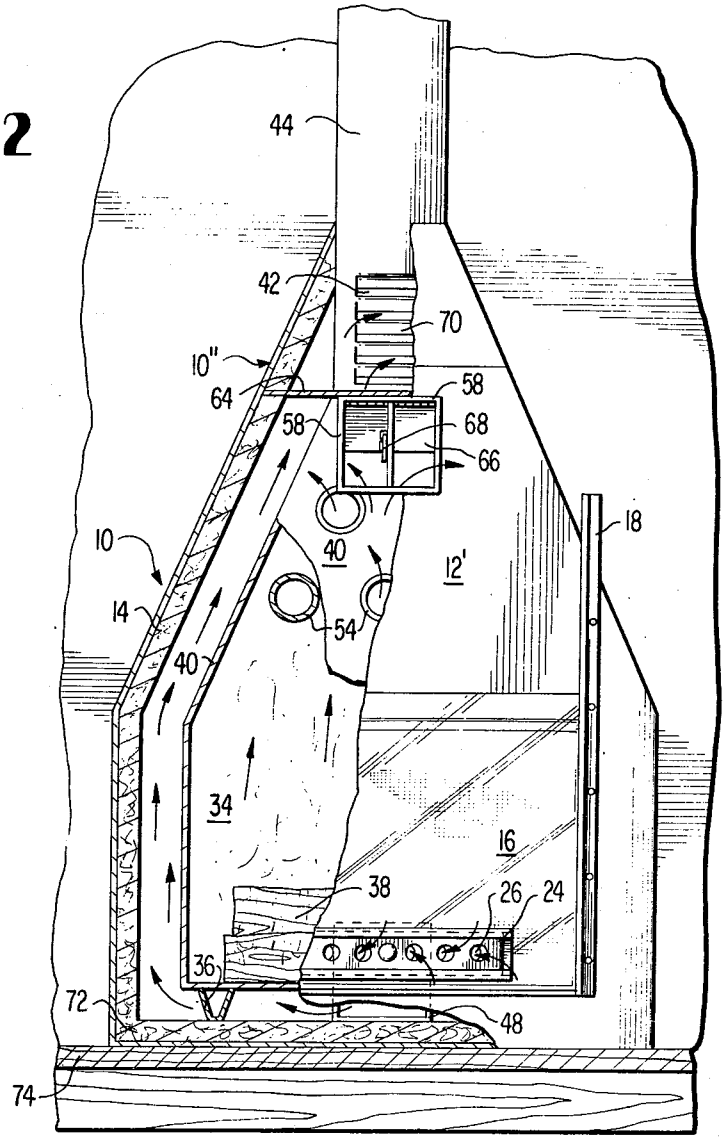
FIG. 2 is a fragmentary plan view of a fireplace heating unit of this invention with a portion of a vertical wall broken away.
Figure 1:
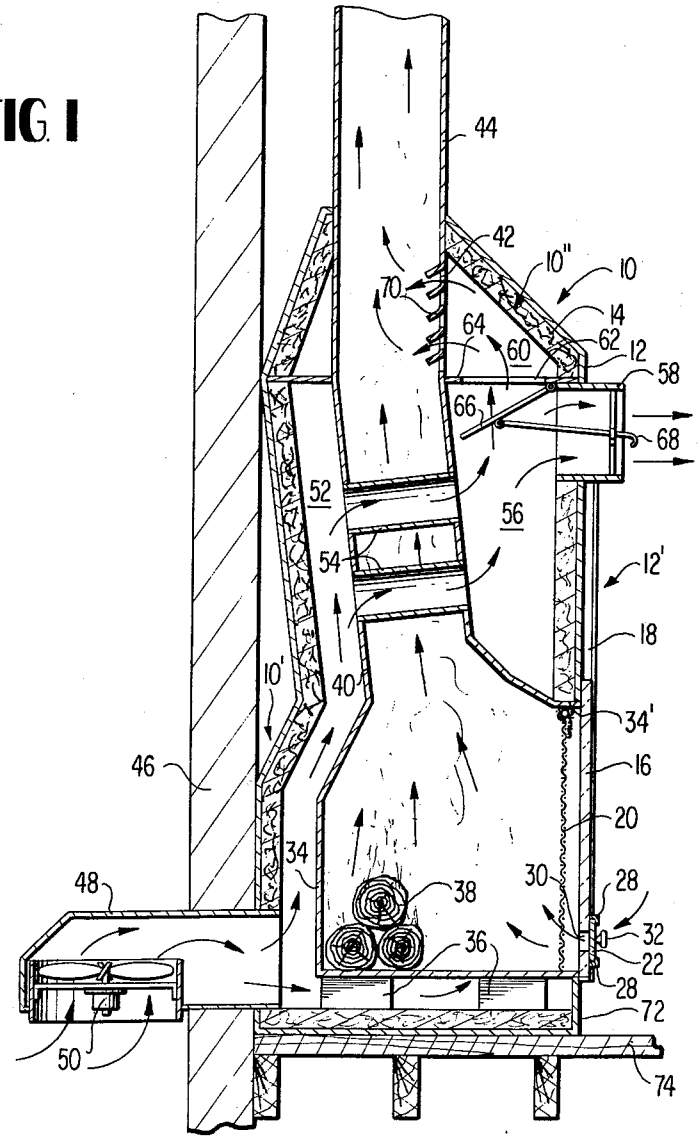
FIG. 1 is a fragmentary side view in vertical section of an embodiment of the fireplace heating unit of this invention.

With attention to the drawings, FIGS. 1 and 2 depict a preferred embodiment of this invention comprising a housing 10 having an outer wall 12 and an inner insulated wall 14 attached thereto. The front 12' of housing 10 may support a conventional brick facade (not shown) as desired. A movable glass door 16 is mounted on tracks 18 affixed to the front wall face 12'. As will be obvious to those skilled in the art the tracks 18 may be hidden by a brick or stone facade (not shown).

Door 16 is intended to move vertically in tracks 18 for access to the interior of the housing 10. A fire screen 20 may also be provided within the housing adjacent door 16, as shown in FIG. 1. The lower portion of door 16 mounts a controlled vent 22 comprising a plate 24 having a plurality of openings 26 therein. Plate 24 is mounted in horizontal tracks 28, and door 16 has corresponding openings 30 therethrough so that lateral movement of plate 24 by pushing knob 32 will open or close the vent.

A firebox 34 is disposed within housing 10 resting on legs 36 integral therewith. The front portion 34' of box 34 forms an opening for access to the interior of box 34 for supplying fuel 38 in the conventional manner. The upper extension of box 34 forms a hood 40 which extends from the firebox 34 to a bonnet 42. The upper portion of bonnet 42 is integral with or may be attached to feed into the chimney flue 44.

Therefore when fuel 38 is consumed in firebox 34, the hot combustion gases travel upwardly through the hood 40, through the bonnet 42 and into the flue 44 for ultimate expulsion into the atmosphere. The rear wall 10' of housing 10 is vented at the lower portion thereof through structural wall 46 to the atmosphere. A fan housing 48 mounting a vertically directed conventional fan 50 is provided for this purpose.

Fan 50 directs a flow of external air through housing 48 and into the interior of housing 10'. The air circulates beneath and around firebox 34. The upwardly flowing air from housing 48 is then preheated as it circulates around box 34 by the fire therein. A portion of the preheated air then enters a chamber 52 disposed at the rear of hood 40. The preheated air then passes through conduits 54, which extend through the upwardly flowing combustion gases in hood 40. The air is then heated by initimate contact with the conduit walls which are heated, in turn, by the upwardly flowing combustion gases. Heated air from conduits 54 then enters a second chamber 56 forward of hood 40.

Housing 10 is provided with a front vent 58 whereby heated air from chamber 56 is expelled into the interior of the structure. The upper portion 10' of housing 10 encloses a third chamber 60. Chamber 60 communicates with chamber 56 through an opening 62 disposed in a horizontal wall 64 which separates chambers 52 and 56 from chamber 60. Passage of heated air from chamber 56 to chamber 60 is controlled by by-pass door 66 which is hingedly attached through horizontal plate 64. By-pass 66 is controlled by a handle means such as hingedly attached rod 68 which extends through the vent 58 in housing 10.

Door 66 then permits a partial or total bypass of vent 58 by placing chamber 56 and the hot air flow directed thereinto into communication with the flue through opening 62, chamber 60, and bonnet 42.

The openings in bonnet 42 are covered by louvers 70 to facilitate the flow of heated air into the bonnet and to frustrate a back-up of combustion gases from the flue 44 into chamber 60.

Housing 10, may be mounted as shown in FIGS. 1 and 2 within a structure on the interior face of a vertical wall 46 with the fan housing passing through an opening in wall 46, and with the base 72 of housing 10 resteing on a floor 74. This embodiment is described as a zero clearance model because it may be mounted against any type of wall without a special base or enclosure of brick, concrete or the like. Because of the design and the insulation provided by inner wall 14 the the skin temperature of housing 10 does not become high enough to be hazardous. In the alternative as will be obvious to those skilled in the art the unit 10 may be mounted outside wall 46 on a platform (not shown). In this instance, the opening 34' would be formed through wall 46, and vent 58 would also extend through wall 46. Tracks 18 and door 16 would then be mounted within the structure in a conventional manner.

Figure 4:
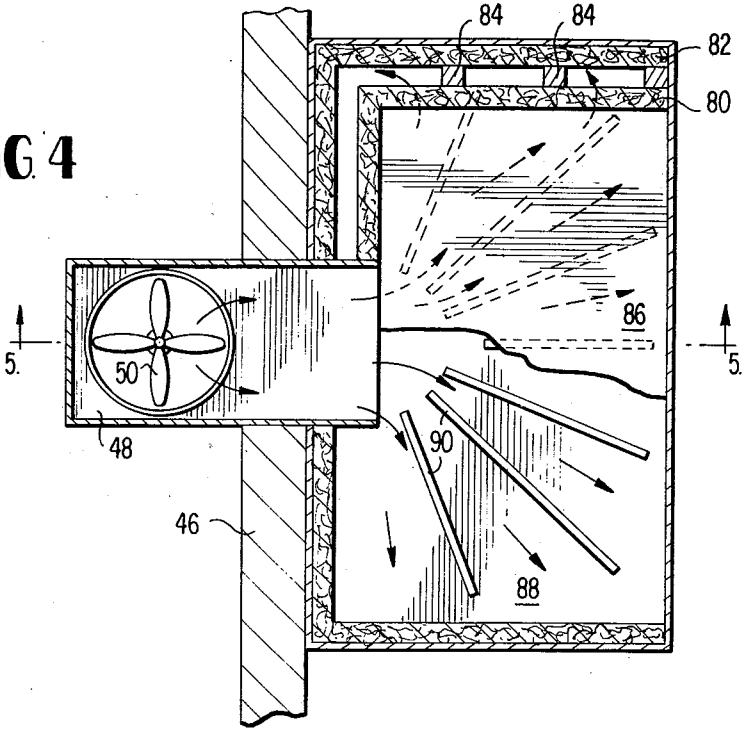
FIG. 4 is a cross-sectional view taken along line 4—4 of FIG. 3.
Figure 5:
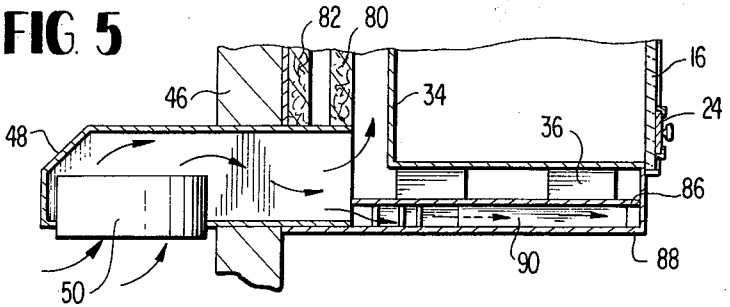
FIG. 5 is a fragmentary cross-sectional view taken along line 5—5 of FIG. 4.
Figure 3:
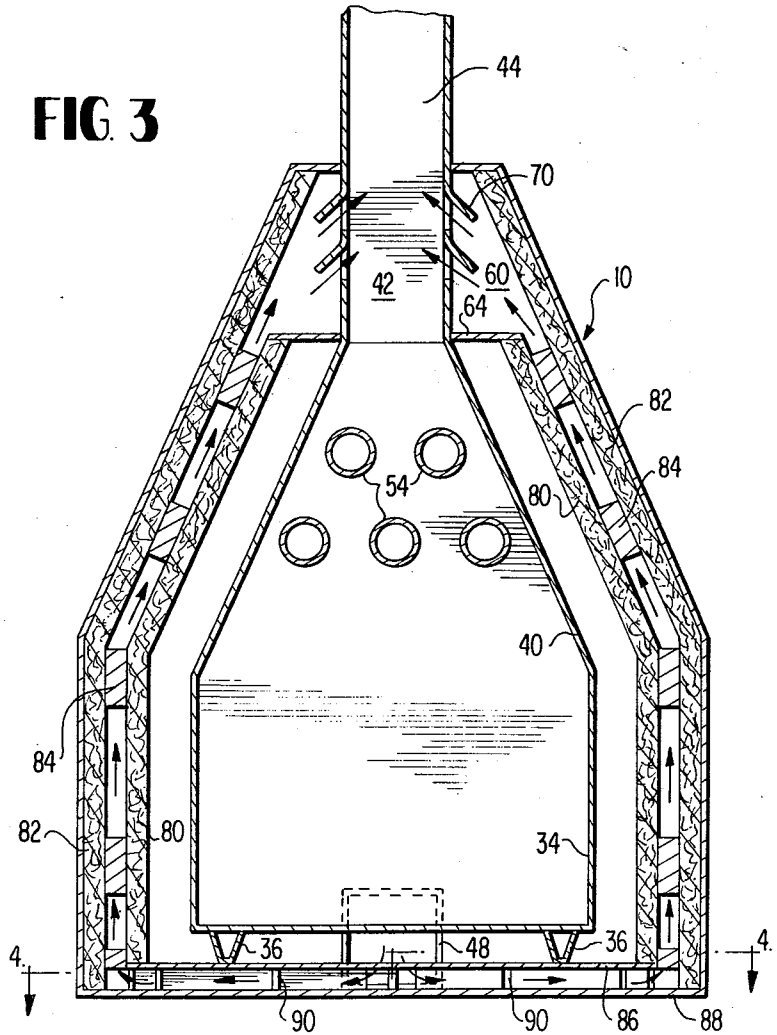
FIG. 3 is a fragmentary plan view in vertical section of an alternate embodiment of the heating unit of this invention.

With attention to FIGS. 3–5, housing 10 may alternatively comprise spaced inner and outer walls 80 and 82, respectively. The space between walls 80 and 82 may be approximately 1 ½ inches, and spacers 84 may be provided at desired intervals as is well known in the art. In addition, the firebox 34 and legs 36 may rest on a false bottom 86 disposed in spaced relationship to bottom 88. The horizontal supports 86 and 88 are separated by vanes 90 as shown in FIG. 4. Vanes 90 provide additional support for the firebox 34 and direct outside air entering the system through housing 48 outwardly toward upstanding walls 84 and 82 wherein it travels to chamber 60. Heated air then exits chamber 60 into flue 44.

It has been observed that when the thickness of walls 80 and 82 is about 1 ½ inches, each, and the walls are formed of fiberglass material with a 1 ½ inch wide space therebetween, a temperature of 400° F. adjacent hood 40 within wall 80 will result in a temperature of about 200° F. in the space between walls 80 and 82, and a temperature of 91° F. on the external surface of wall 82.

Figure 6:
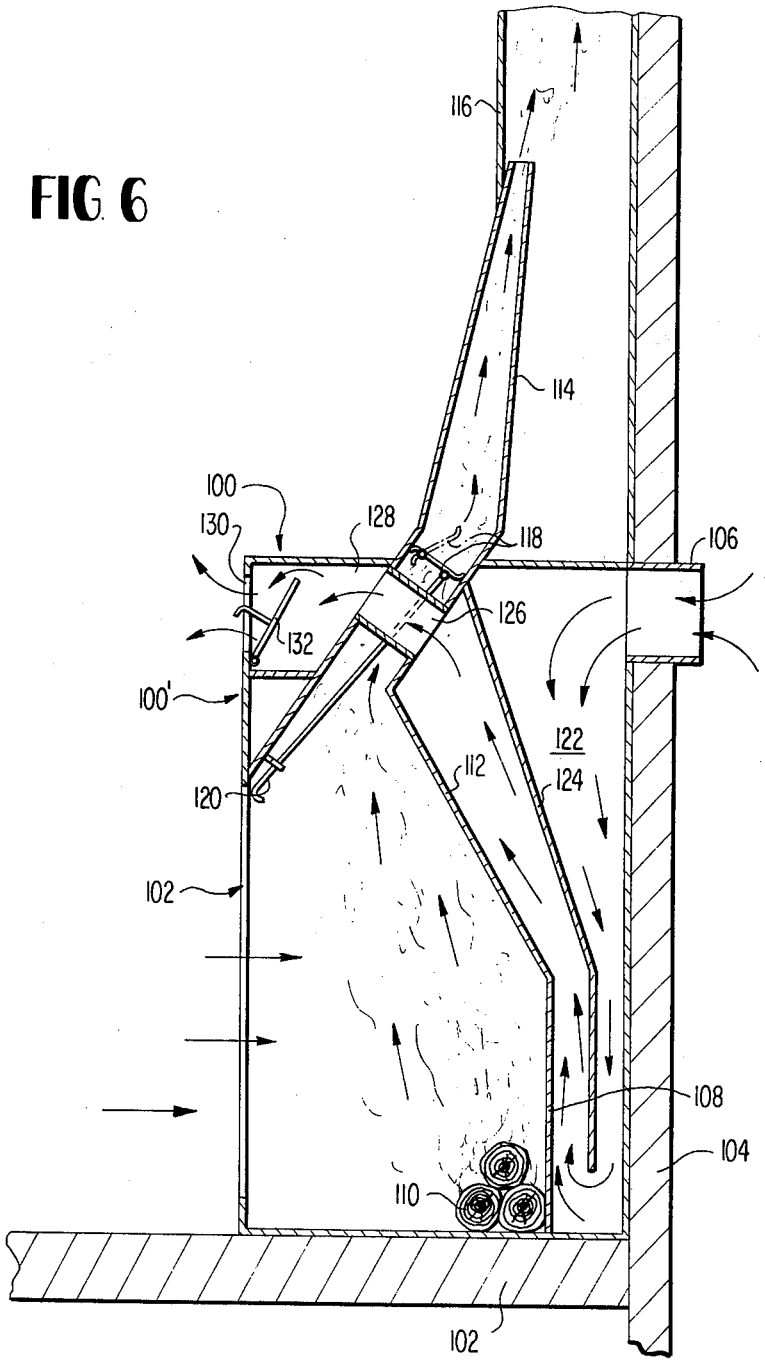
FIG. 6 is a fragmentary side view in vertical section of an alternate embodiment of the fireplace heating unit of this invention.

FIG. 6 depicts an alternative embodiment of the heating unit of this invention. With attention to FIG. 6, an external housing 100 is intended to be free standing with heat resistant adjacent supports. Housing 100 rests adjacent juncture of a floor 102 and a vertical wall 104. Housing 100 is vented through wall 104 at the upper portion thereof by conduit 106. As will be subsequently explained conduit 106 need not have a fan assembly similar to the assembly 48 in FIGS. 1–5, but such assembly could be utilized if desired.

Housing 100 forms a front opening 102 similar to opening 34' formed in the embodiment of FIGS. 1–5. The front portion 100' of housing 100, surrounding opening 102, may mount a brick or stone facade in the conventional manner, and may mount a movable door similar to door 16 in tracks 18 with a controlled vent 24 as described above with relation to FIGS. 1 and 2. For the purposes of explanation, however, these features have been deleted from FIG. 6.

A firebox 108 is formed within housing 100 wherein fuel 110 is placed for consumption in the usual manner, through opening 102. A hood 112 is disposed above box 108 as an upwardly extending extension thereof. Hood 112 terminates in a conical conduit 114 which conveys the combustion gases from fuel 110 into the chimney flue 116. A conventional damper 118 may be provided in the upper portion of hood 112. Damper 118 may be controlled by a rod 120 hingedly attached thereto.

Exterior air enters housing 100 through the rear vent 106 and passes downwardly through chamber 122 and under depending baffle 124. The preheated outside air then passes upwardly along the exterior of firebox 108 and between hood 112 and baffle 124 to conduits 126 extending through the upper extension of hood 112. As the air passes through conduits 126 it comes into intimate contact with the walls thereof which are heated by the upwardly flowing combustion gases. The heated air then exits conduits 126 into forward collection chamber 128. Chamber 128 is vented to the interior of the room by vent 130. Vent 130 is controlled by a hinged door 132.

It has been discovered that absent baffle 124, and absent a fan arrangement similar to that of FIGS. 1–5, the interior air will tend to blow back through vent 130, and through chambers 128 and 122 and vent 106 to the outside. However, by providing the baffle, the blow-back of interior air is prevented. As the air is continually preheated and then exhaused through vent 130, as shown in FIG. 6, outside air is continually drawn into the system through vent 106 and circulated through chambers 122 and 128.

The semi-portable embodiments of this invention shown at FIGS. 1–5 are especially adapted for mounting in newly constructed structures, mobile homes, or existing structures, and may be installed, quickly and inexpensively, as will be obvious to those skilled in the art, against any convenient wall.

The units of this invention, as noted above, may be used as conventional fireplaces when desired, but to achieve efficient heating it is preferred to close the front openings with a glass door, as shown in FIGS. 1 and 2, so that the unit may be used as a space heater.

In addition, it should be noted that the device of FIG. 6 may also be constructed with double, spaced walls similar to those shown in FIGS. 3–5, if desired.

The invention herein may be described as residing in the following:

a fireplace heating unit comprising: a flue; a housing having a base, upstanding walls in a roof, and having a front opening therein for receiving fuel to be burned, a front vent disposed over the opening for expelling heated air from said housing, and a rear vent for admitting cool, outside air to the interior of said housing; a firebox mounted in said housing, and adapted to contain a fire therein, said firebox having a front opening for admitting fuel to said fire disposed in alignment with and immediately adjacent the front opening of said housing, the rear wall of said firebox being spaced away from the rear wall of said housing to define a first chamber; hood means mounted on the upper portion of said firebox within said housing for collecting the hot combustion gases from a fire therein; flue vent means carried by said hood means for venting hot combustion gases collected by said hood means through said housing and into said flue; heating means carried by said housing for circulating cool outside air admitted to said first chamber through said rear vent, from said first chamber and through said hood means and for expelling at least a portion of said heated air through said front vent whereby said outside air is heated by the combustion gases in said hood when fuel is consumed in said firebox.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

The embodiments of the invention in which an exclusive property of privilege is claimed are defined as follows:

1. A fireplace heating unit comprising:

a flue;

a housing having a base, upstanding walls and a roof, and having a front opening therein for receiving fuel to be burned, a front vent disposed over the opening for expelling heated air from said housing, and a rear vent for admitting cool, outside air to the interior of said housing;

a firebox mounted within said housing and adapted to contain a fire therein, said firebox having a front opening for admitting fuel to said fire disposed in alignment with and immediately adjacent the front opening of said housing, the rear wall of said firebox being spaced away from the rear wall of said housing to define a first chamber;

hood means mounted on the upper portion of said firebox within said housing for collecting the hot combustion gases from a fire therein said hood means including a front wall portion spaced away from the front wall of said housing to define a second chamber immediately adjacent said front vent;

flue vent means carried by said hood means for venting hot combustion gases collected by said hood means through said housing and into said flue;

heating means carried by said housing for circulating cool outside air, admitted to said first chamber through said rear vent, from said first chamber, through said hood means and into said second chamber, and for expelling at least a portion of said heated air through said front vent whereby said outside air is heated by the combustion gases in said hood means when fuel is consumed in said firebox;

a divider wall extending across the interior of said housing and disposed above the front vent and said first and second chambers, to define, with the upper portion of said housing, a third chamber; bypass means carried by said unit for selectively venting heated air from said second chamber into said third chamber and from said third chamber into said flue;

said flue vent means comprising conduit means extending through the upper portion of said hood, through said third chamber and into said flue for communication between the interior of said hood and said flue therethrough said bypass means comprising one-way valve means carried by said conduit means and disposed within said third chamber for admitting heated air from said chamber into said flue through said conduit means without diverting combustion gases therefrom into said chamber.

2. The unit of claim 1 further comprising fan means mounted in said rear vent for directing cool outside air through said vent and into said first chamber.

3. The unit of claim 1 wherein said divider wall defines a port therethrough and said bypass means includes closure means carried by said unit and disposed in said port for opening and closing said port.

4. The unit of claim 3 wherein said closure means comprises a door hingedly attached to the lower surface of said divider wall, and handle means mounted on said door and extending through said front vent for opening and closing said door.

5. The unit of claim 1 further comprising movable closure means mounted on said housing at said front opening for selectively admitting a controlled flow of air therethrough into said firebox to control combustion therein.

6. The unit of claim 5 wherein said closure means comprises a transparent fire resistant door having valve means mounted at the lower portion thereof for admitting a preselected flow of air therethrough to the interior of said firebox.

7. The unit of claim 1 wherein the walls of said housing are insulated.

8. The unit of claim 7 wherein said housing further comprises inner and outer spaced, insulated walls.

9. The unit of claim 7 wherein said firebox further comprises a plurality of leg members mounted on the under-surface thereof so that the base of said housing and of said firebox define an air space therebetween; and means carried by said unit for circulating air from said rear vent through said space to said second chamber.

10. The device of claim 8 further comprising circulating means carried by said unit for circulating cool air from said rear vent between the inner and outer walls of said housing and into said flue.

11. The unit of claim 1 wherein said rear vent in said housing is spaced above the base thereof, said unit further comprising depending baffle means disposed within said housing behind said firebox for circulating cool air from said vent downwardly along the rear wall of said housing and then upwardly along the rear wall of said firebox in said first chamber.

12. The device of claim 1 wherein said heating means comprises at least one conduit extending from said first chamber, through said hood, and into said second chamber.

13. The unit of claim 12 wherein said heating means comprises a plurality of conduits extending from said first chamber, through said hood, and into said second chamber.

* * * * *